United States Patent [19]

Gigliotti, Jr.

[11] Patent Number: 5,041,262

[45] Date of Patent: Aug. 20, 1991

[54] METHOD OF MODIFYING MULTICOMPONENT TITANIUM ALLOYS AND ALLOY PRODUCED

[75] Inventor: Michael F. X. Gigliotti, Jr., Scotia, N.Y.

[73] Assignee: General Electric Company, Schenectady, N.Y.

[21] Appl. No.: 418,427

[22] Filed: Oct. 6, 1989

[51] Int. Cl.[5] ..... C22C 14/00

[52] U.S. Cl. ..... 420/419; 148/11.5 F; 148/12.7 B; 148/133; 420/418

[58] Field of Search ..... 420/419, 418; 148/11.5 F, 12.7 B, 133

[56] References Cited

U.S. PATENT DOCUMENTS

| | | | |
|---|---|---|---|
| 4,631,092 | 12/1986 | Ruckle et al. | 148/11.5 F |
| 4,639,281 | 1/1987 | Sastry et al. | 420/419 |
| 4,842,652 | 6/1989 | Smith et al. | 148/12.7 B |
| 4,849,168 | 7/1989 | Nishiyama et al. | 420/417 |

*Primary Examiner*—Upendra Roy

*Attorney, Agent, or Firm*—Paul E. Rochford; James C. Davis, Jr.; James Magee, Jr

[57] ABSTRACT

A novel titanium base alloy having a micrograph with alpha plates oriented in three directions with respect to their parent beta grains, but with alpha plates so short that no basketweave pattern is evident. The alloy contains from 0.02 to 2.0 atomic percent boron; 6 to 30 atomic percent aluminum; 0 to 4 atomic percent tin; 0 to 4 atomic percent gallium; and may contain 0 to 6 atomic percent zirconium of hafnium or a mixture of the two; 0 to 12 atomic percent of at least one metal selected from the group consisting of vanadium, columbium, tantalum, chromium, molybdenum, rhenium, tungsten, ruthenium, and the platinum group metals; and from 0 to 2 atomic percent of at least one element selected from the group consisting of yttrium, carbon and the rare earth metals.

10 Claims, 5 Drawing Sheets

FIG. 5A YF. Ti-18Al-5Cb-0.8Si
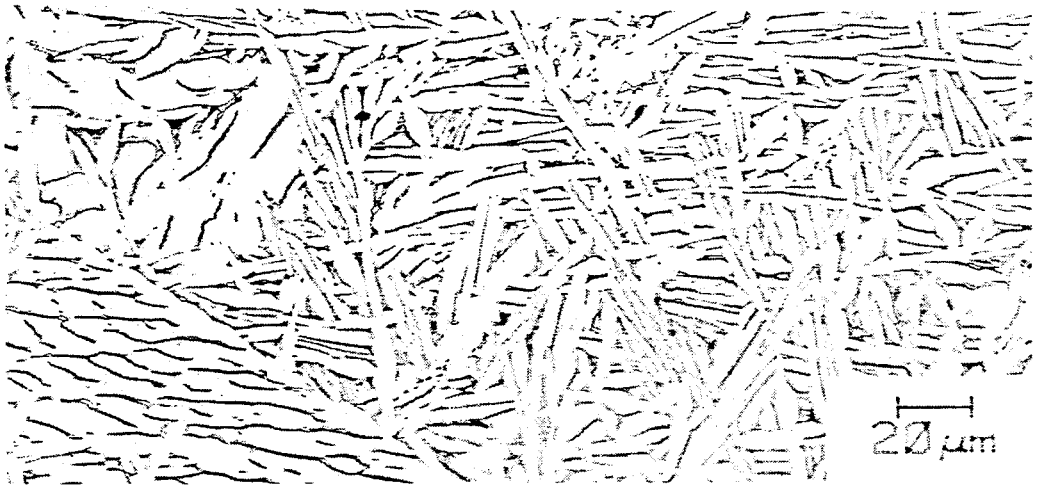
FIG. 5B YK. Ti-18Al-5Cb-0.8Si-0.06B
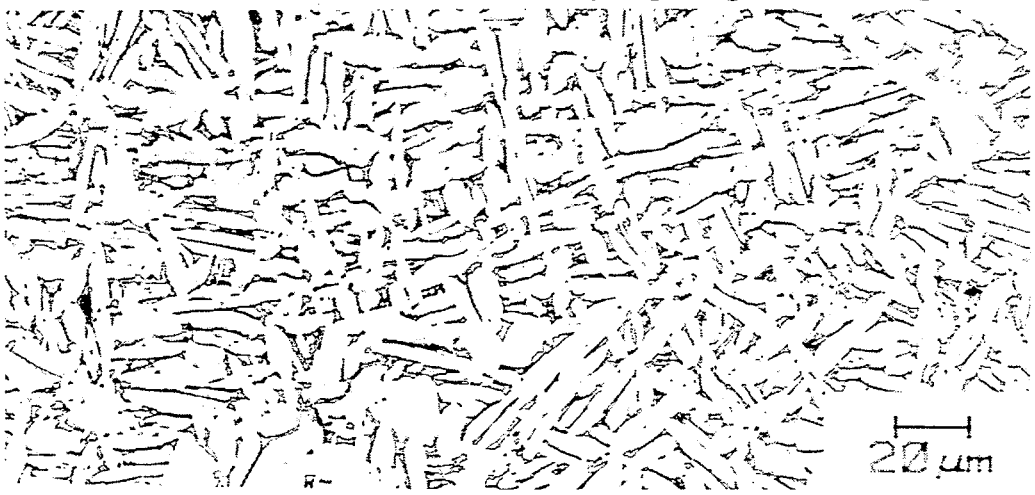
FIG. 5C YL. Ti-18Al-1.5Hf-5Cb-0.8Si-0.6B
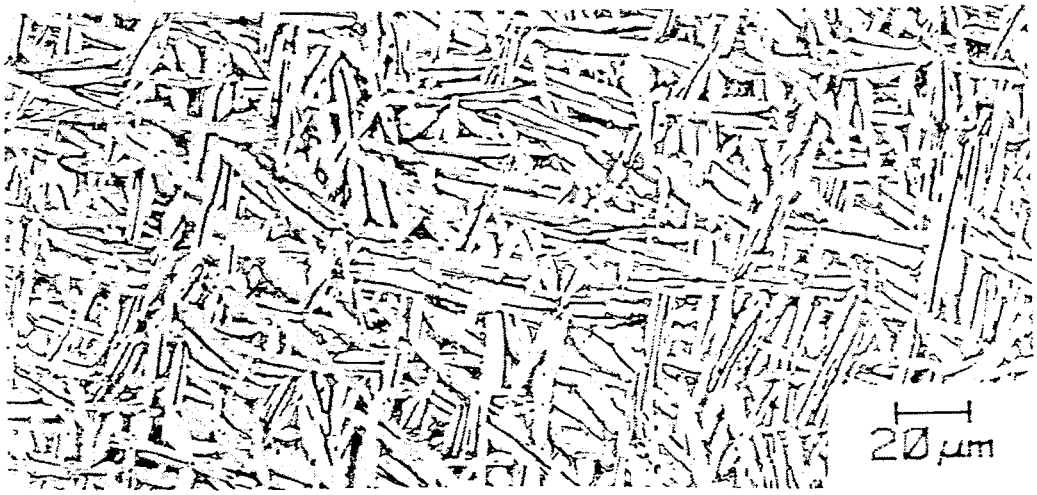

FIG. 6A YQ. Ti-18Al-5Ta-0.8Si
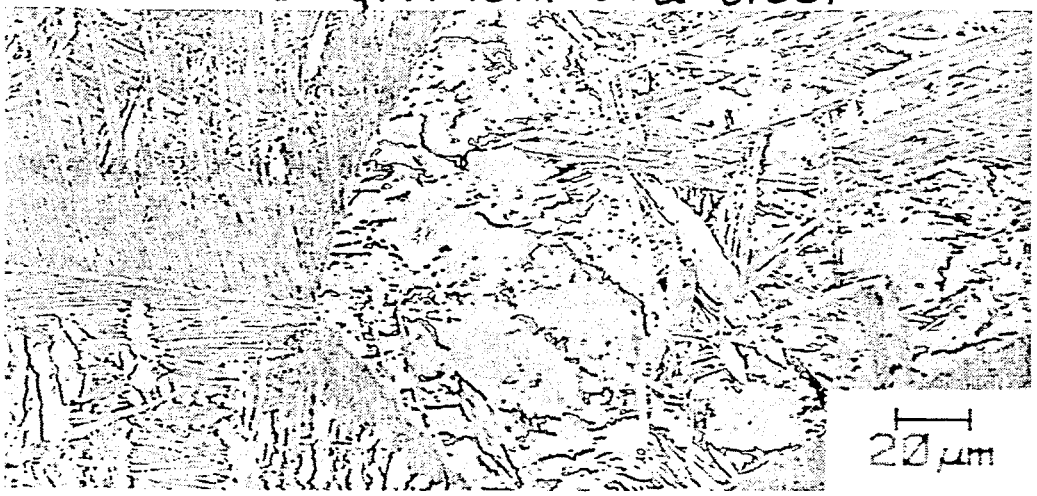
FIG. 6B YR. Ti-18Al-1.5Hf-5Ta-0.8Si-0.06B
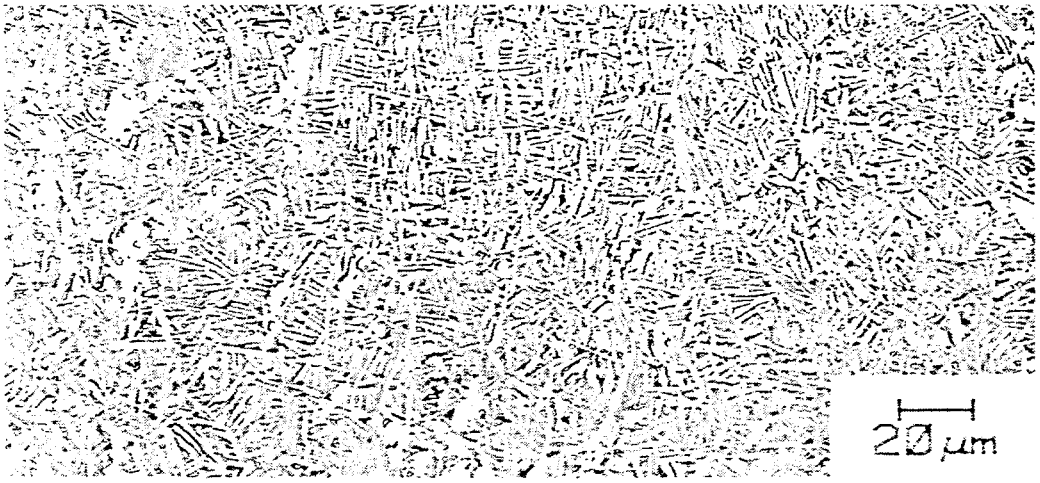
FIG. 6C YV. Ti-22.5Al-1.5Hfa-0.8Si-0.06B
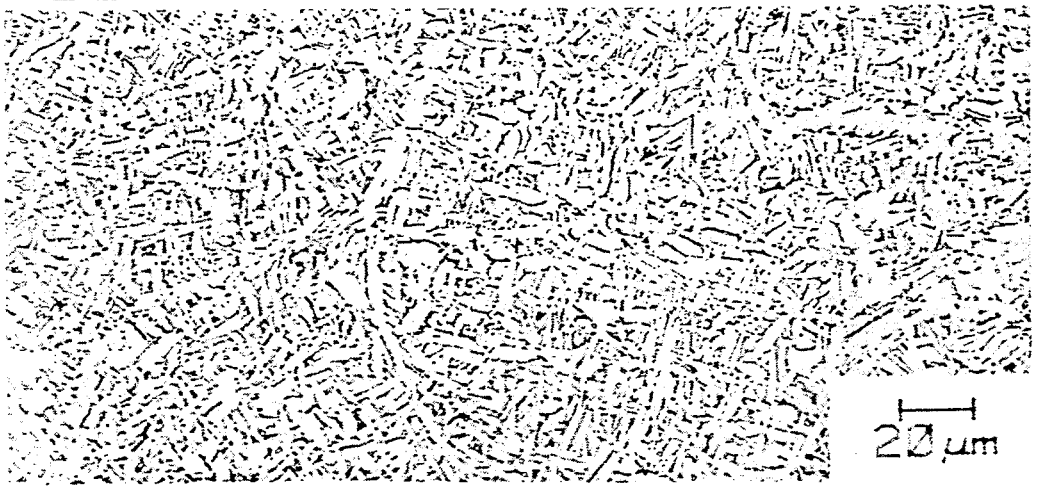

FIG. 7A YQ. Ti-18Al-5Ta-0.8Si
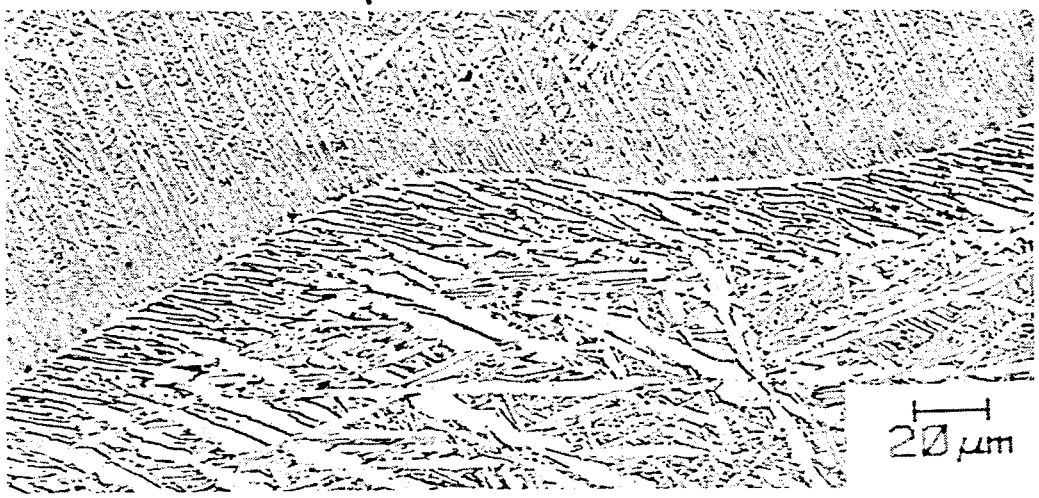
FIG. 7B YR. Ti-18Al-1.5Hf-5Ta-0.8Si-0.06B
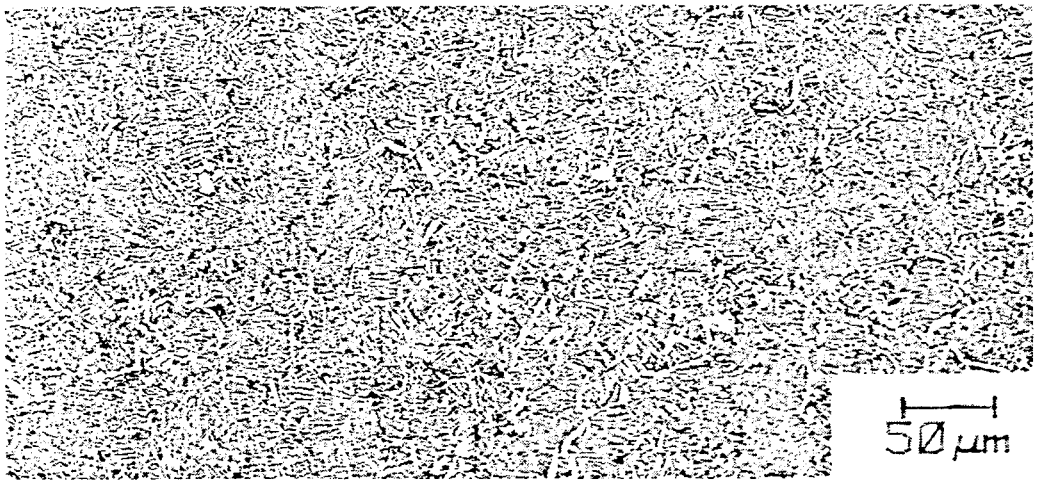
FIG. 7C YV. Ti-22.5Al-1.5Hf-5Ta-0.8Si-0.06B
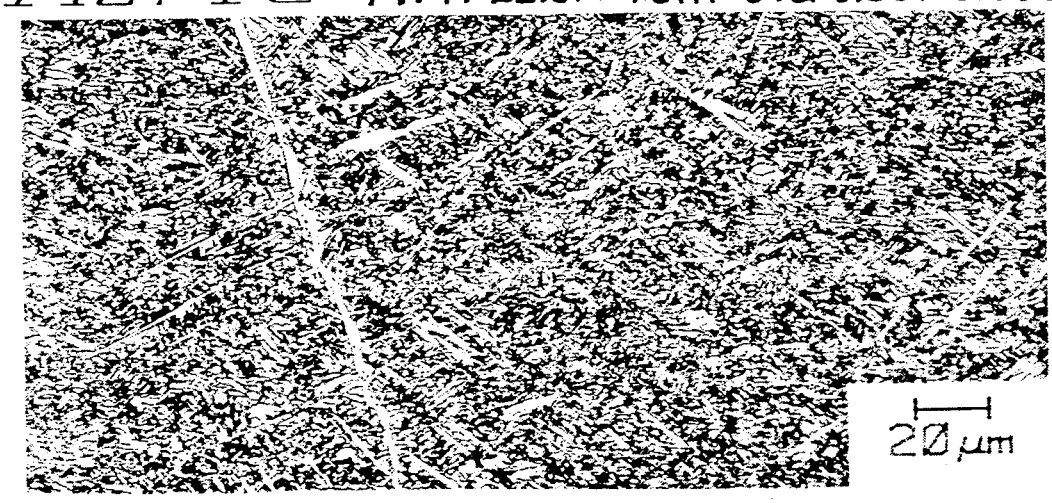

METHOD OF MODIFYING MULTICOMPONENT TITANIUM ALLOYS AND ALLOY PRODUCED

BACKGROUND OF THE INVENTION

The present invention relates to improvements in titanium alloys. More particularly, it relates to multicomponent titanium alloys which are improved by the addition of boron thereto in a prescribed compositional and processing relationship.

It is known that there is a continuing need for titanium alloys with improved performance at elevated temperatures. Further, it is known that titanium alloys with high aluminum content have good elevated temperature properties but suffer in that they have poor room temperature ductility. Any modification of titanium alloys with high aluminum to increase the low temperature ductility would be very beneficial in that it would permit new uses of such high aluminum titanium alloys in demanding applications such as in jet engines.

It is known in the art that conventional high temperature titanium alloys have been limited in their high temperature capabilities because of the difficulty or impossibility of adding alloying elements beyond a given level without room temperature embrittlement. This was described originally in a January 1957 article in the Journal of Metals, entitled "Embrittlement of Ti-*Al Alloys in the* 6–10% *Al Range*", authored by Crossley and Carew, at pages 43–46, and describing levels above about 6 weight percent causing brittle behavior which behavior was reported to be made worse by thermal exposure.

Development work has proceeded along the path recognized by Crossley and Carew until it was recognized that any strengthening; element which behaves like aluminum will cause embrittlement. Consequently, it was recognized in the art that the elements—tin, zirconium and oxygen—all had to be controlled to lower concentrations in order to avoid the embrittlement. The most modern current titanium base alloys, such as Ti-1100, described by Bania in "*An Advanced Alloy for Elevated Temperatures*" in the March 1988 issue of the Journal of Metals, on pages 20–22, and in U.S. Pat. No. 4,738,822, entitled "TITANIUM ALLOY FOR ELEVATED TEMPERATURE APPLICATIONS; WITH ALUMINUM, ZIRCONIUM, MOLYBDENUM, SILICON, AND IRON", contain only about 6 weight percent aluminum, evidently for the same reason.

An alternative approach to alloying was described by Blackburn and Smith in U.S. Pat. No. 4,292,077, entitled "TITANIUM ALLOYS OF THE $Ti_3Al$ TYPE" and also in U.S. Pat. No. 4,716,020 entitled "TITANIUM ALUMINUM ALLOYS CONTAINING NIOBIUM, VANADIUM AND MOLYBDENUM". It was pointed out in these patents that titanium base alloys with higher aluminum content, above the amount that cause formation of alpha two ($Ti_3Al$) as the major phase, and with additions of refractory elements such as niobium (columbium) or vanadium, can result in production of a finite volume fraction of a ductilizing beta phase. However, the limitation of this approach is that the beta phase, required for the room temperature ductility, seriously degrades the strength of such alloys at temperatures of 650° C. and above.

It is known that boron has low solubility in titanium and the effects of boron additions to titanium base alloys are described in a reference text entitled "Binary Alloy Phase Diagrams" published by the American Society of Metals (1986) and edited by editor-in-chief Thaddeus B. Massalski and editors Joanne L. Murray, Lawrence H. Bennett, and Hugh Baker. According to this reference, boron additions to titanium base alloys would be expected to result in precipitates of boride phase and would, accordingly, not be expected to have a modifying effect on a titanium matrix microstructure.

The use of boron to form a second phase compound is well-known in various classes of titanium alloys that have been prepared by conventional solidification and thermomechanical processing techniques. Jaffee, Maykuth, and Ogden in U.S. Pat. Nos. 2,596,489 and 2,797,996 describe alpha and alpha plus beta titanium alloys which would contain boron at a sufficiently high level that it would form a boride dispersed phase. Jaffee in U.S. Pat. No. 2,938,789 describes beta titanium matrix compositions with boride or silicide phases. Brooks, Brown, and Jepson in U.S. Pat. No. 3,199,980, describe titanium alloys with boride or carbide precipitates. Evans and Smith in U.S. Pat. No. 3,340,051 describe a titanium-chromium alloy with boron at a sufficiently high level that it contains a dispersed boride phase, and in U.S. Pat. No. 3,399,059 they describe titanium-molybdenum-vanadium beta matrix compositions containing boron. In contrast, the titanium alloy compositions and processing of my invention yield modified alpha matrix phase microstructures and improved low temperature ductility via using boron at lower levels of concentration and rapidly solidifying the alloy compositions to *prevent* the formation of dispersed borides.

Boron containing alloys at lower levels were described by Itoh, Miyauchi, Sagoi, and Watanabe in U.S. Pat. No. 4,253,873. They describe an optional addition of boron at a sufficiently low level that it might not form borides. However, the alloys of their invention have such low levels of the alpha promoter aluminum that embrittlement by $Ti_3Al$ is not an issue, and such high levels of the beta promoting elements chromium and molybdenum that the alloy has either a retained beta matrix or a chromium eutectoid microstructure. In contrast, the alloys and processing of my invention relate to improving the ductility of high aluminum alloys and to modifying an alpha plate microstructure.

Rapid solidification of boron-containing titanium alloys was described by Vordahl in U.S. Pat. Nos. 3,622,406 and 3,379,522. These alloy compositions were chosen to have a sufficiently high level of boron that it would form dispersoids. The purpose of rapid solidification was to refine these dispersoids.

In a September 1983 article in the Journal of Metals, pages 21–27, entitled "*Rapid Solidification Processing of Titanium Alloys*", S. M. L. Sastry, T. C. Peng, T. J. Meschter, and J. E. O'Neal reported that rapid solidification of boron containing compositions was expected to result in a refined array of borides potentially useful as dispersoids. They taught this further in U.S. Pat. No. 4,639,281.

Similarly, in an article entitled "*Control of Beta-Grain Growth Via The Powder Metallurgy Route In A Ti-6Al-4V Alloy*" by H. Octor, S. Naka, M. Marty, and A. Walder, appearing in a reference entitled "*Annealing Processes, Recovery, Recrystallization, and Grain Growth*", published by Riso of Denmark (Dec. 8–12, 1986), it was pointed out that boron present in a titanium base alloy as a precipitate might be expected to refine the beta grain size. In this work, additions of base boron were made to the Ti-6Al-4V alloy by blending powders. Boron was observed to prevent beta grain growth. In this article and in the previous article, no modification of the alpha titanium microstructure was observed or reported.

It is known that the presence of boron and conventionally solidified titanium alloys and in titanium alloy weldments has a negative impact on low temperature ductility. Two articles on the behavior of an alpha titanium alloy containing boron reveal that there is no modification on the alpha plate microstructure and there is degradation in the mechanical properties at room temperature where the boron is present. The first article is entitled "*Boron Induced Toughness Loss in Ti-6Al-2Nb-1Ta-0.8Mo*", by H. Inouye and S. A. David, and an article entitled "*The Effect of Boron on Weldment Microstructures In The Ti-6Al-2Nb-1Ta-1Mo Alloy*", by R. E. Lewis, W. C. Kuhns, F. A. Crossley, I. L. Kaplan, and W. E. Lukens. Both articles appeared in the Proceedings of the Fifth International Conference on Titanium, in Munich, F.R.G. (Sept. 10–14, 1984) as edited by G. Lutjering, U. Zwiker, and W. Bunk.

By contrast to the findings reported in the literature, I have found that a titanium base alloy can be provided which has improved low temperature strength and ductility and which also possesses good high temperature strength and that this can be accomplished by additions of boron combined with rapidly solidification of high aluminum content alloys to modify the alpha plate microstructure.

BRIEF STATEMENT OF THE INVENTION

It is, accordingly, one object of the present invention to provide titanium alloys with improved low temperature strength and ductility and with good high temperature strength.

Another object is to provide a method of modifying titanium alloy compositions to improve low temperature strength and ductility with minimal changes in high temperature strength.

Another object is to provide a boron containing titanium base alloy composition which has a desirable combination of low temperature, ductility, and strength, and also has good high temperature strength.

Other objects will be in part apparent and in part pointed out in the description which follows.

In one of its broader aspects, objects of the present invention can be achieved by providing a titanium base alloy containing about 0.01 up to 0.2 atomic percent boron and which contains between 6 and 30 atomic percent of aluminum. The titanium base alloys of this invention are relatively high in aluminum but are not embrittled by the high aluminum content because of the presence of boron additive.

In another of its aspects, the objects of the present invention can be achieved by providing an alloy having the following approximate composition in atomic percent:

| Ingredient | Concentration From About | Concentration To About |
|---|---|---|
| Al | 6 | 30 |
| Sn | 0 | 4 |
| Ga | 0 | 4 |
| Σ Al + Sn + Ga | 6 | 30 |
| Zr | 0 | 6 |
| Hf | 0 | 6 |
| Σ Zr + Hf | 0 | 6 |
| V | 0 | 12 |

-continued

| Ingredient | Concentration From About | Concentration To About |
|---|---|---|
| Cb(Nb) | 0 | 12 |
| Ta | 0 | 12 |
| Mo | 0 | 6 |
| W | 0 | 6 |
| Cr | 0 | 6 |
| Ru | 0 | 4 |
| Rh | 0 | 4 |
| Pd | 0 | 4 |
| Pt | 0 | 4 |
| Ir | 0 | 4 |
| Os | 0 | 4 |
| Σ V + Cb + Ta + Cr + Mo + W + Ru + Rh + Pd + Pt + Ir + Os | 0 | 12 |
| Σ C + Y + Rare Earth Metals | 0 | 2 |
| B | 0.01 | 2.0 |
| Ti | balance essentially | |

the final microstructure of said alloy being characterized by an average alpha phase plate length of less than 50 microns.

In still another of its aspects, a finer microstructure is formed with a composition as follows in atomic percent:

| Ingredient | Concentration From About | Concentration To About |
|---|---|---|
| Al | 16 | 20 |
| Sn | 0 | 4 |
| Ga | 0 | 4 |
| Σ Al + Sn + Ga | 16 | 20 |
| Zr | 0 | 2 |
| Hf | 0 | 2 |
| Σ Zr + Hf | 0 | 2 |
| Cb (Nb) | 0 | 5 |
| Ta | 0 | 5 |
| Σ V + Cb + Ta + Mo + W | 4.5 | 5.5 |
| B | 0.01 | 0.4 |
| Ti | balance essentially | |

the final microstructure of said alloy being characterized by an average alpha phase plate length of less than 30 microns.

As used herein, the phrase "balance essentially" is used to include, in addition to titanium and the elements expressly listed above, small amounts of impurities and incidental elements in amounts which do not adversely affect the novel advantageous characteristics of the alloy.

BRIEF DESCRIPTION OF THE DRAWINGS

The description of the invention which follows will be understood with greater clarity if reference is made to the accompanying drawings in which:

FIG. 5 displays the microstructure of the alloys of FIGS. 1 and 2;

FIG. 6 displays the microstructures of the alloys of FIGS. 3 and 4; and

FIG. 7 displays conventionally processed alloys containing boron.

DETAILED DESCRIPTION OF THE INVENTION

Figure 1:
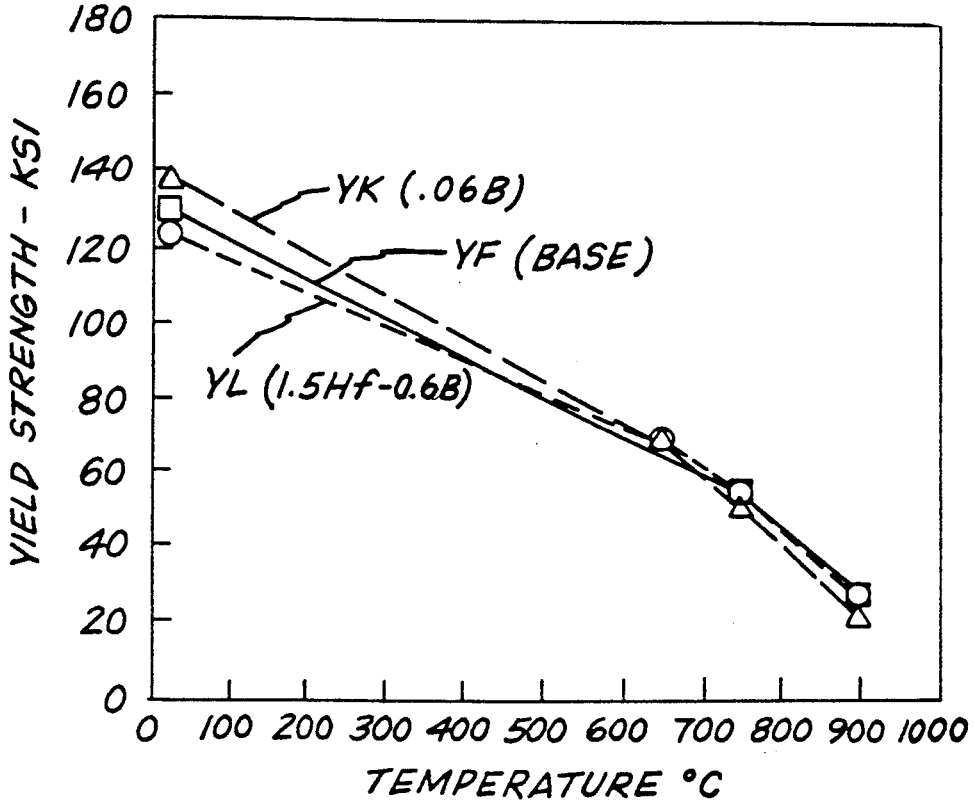
FIG. 1 is a graph in which yield strength is plotted against temperature in degrees centigrade for a group of alloys of similar base composition.

A number of alloys were prepared and tested in order to determine the important compositional and other influences on alloy properties. Ten alloys were prepared identified as alloys YF, YK, and YL; YQ, YR, and YV; YC and YM; and YI and YN.

The grouping of the alloys into a first group of three, a second group of 3, a third group of 2, and a fourth group of 2 is done based on the differences in compositions of the various alloys as is evident from an examination of the Table I immediately below.

TABLE I

| | Composition of Alloys | | | | | | | | | |
|---|---|---|---|---|---|---|---|---|---|---|
| Alloy | Ti | Al | Hf | Ga | Sn | Cb | Ta | Si | B | |
| YF | 76.20 | 18.00 | | | | 5.00 | | 0.80 | | |
| YK | 76.14 | 18.00 | | | | 5.00 | | 0.80 | 0.06 | |
| YL | 76.64 | 18.00 | 1.50 | | | 5.00 | | 0.80 | 0.06 | |
| YQ | 76.20 | 18.00 | | | | | 5.00 | 0.80 | | |
| YR | 74.64 | 18.00 | 1.50 | | | | 5.00 | 0.80 | 0.06 | |
| YV | 70.14 | 22.50 | 1.50 | | | | 5.00 | 0.80 | 0.06 | |
| YC | 73.20 | 12.00 | | 3.00 | 3.00 | 6.00 | 2.00 | 0.80 | | |
| YM | 71.64 | 12.00 | 1.50 | 3.00 | 3.00 | 6.00 | 2.00 | 0.80 | 0.06 | |
| YI | 76.20 | 12.00 | | 3.00 | 3.00 | 3.00 | 0.50 | 0.80 | | 0.50 V, 0.50 Mo, 0.50 W |
| YN | 74.64 | 12.00 | 1.50 | 3.00 | 3.00 | 3.00 | 0.50 | 0.80 | 0.06 | 0.50 V, 0.50 Mo, 0.50 W |

It will be noted from the content of Table I that the four groups of alloys each contain a first alloy listed without any boron content The second alloy of the group and all later members of each group do contain boron in the amount of 0.06 atom percent. Also please note that hafnium is added to the third or second alloy of each group.

With reference again to Table I, some comments are offered here based on prior art observations of the results which are expected from alloy preparation of the compositions as listed in Table I.

The base alloy YF has the composition Ti-18 At % Al-5 At % Cb-0.8 At % Si. Based on prior art teachings, the phase as present in this alloy would be an aluminum-rich hexagonal close packed alpha phase in which there are precipitates of an ordered phase based on $Ti_3Al$ (alpha 2) and a small amount of a columbium-rich body-centered cubic beta phase.

The alloy YK has the same base ingredients as alloy YF with the exception that it also contains 0.06 atomic percent of boron. Based on prior art teachings, this alloy would be expected to contain the same phases as alloy YF. The boron at this low level of addition would further be expected to stay in solution or precipitate as a very low volume fraction TiB phase.

The alloy YL has the same base as alloy YF but has, in addition to the base elements of alloy YF, 1.5 atomic percent of hafnium and 0.06 atomic percent of boron. Accordingly, the alloy YL is equivalent to alloy YK with the addition of 1.5 atomic percent of hafnium. Based on prior art considerations, the hafnium would be expected to go into solid solution in both alpha and beta titanium and perhaps help form hafnium silicides and hafnium borides. The low levels of the boron and silicon would cause the amounts of silicide and boride phases to be quite low and the phase composition of alloy YL would be expected to be almost identical to that of the base alloy YF.

With reference again to Table I, the base alloy YQ has the composition Ti-18 At % Al-5 At % Ta-0.8 At % Si. Based on prior art considerations, the phases present in this alloy would be expected to be an aluminum-rich hexagonal close packed alpha phase in which there are precipitates of an ordered phase based on $Ti_3Al$ (alpha 2) and a small amount of a tantalum-rich body centered cubic beta phase. The alloy YR is essentially the same as the base alloy YQ with the exception that alloy YR also contains 1.5 atomic % Hf and 0.06 atomic percent of boron. Accordingly, it is evident that alloy YR is essentially alloy YQ with the addition of the 1.5 atomic percent hafnium and the 0.06 atomic percent of boron. The distribution of the hafnium and boron in the alloy YR based on prior art considerations is similar to that discussed above with respect to alloys YK and YL. In particular, the hafnium in alloy YR would be expected to go into solid solution in both alpha and beta titanium and perhaps help form hafnium silicides and hafnium borides. The low levels of the boron and silicon would be expected to cause the amounts of the boride and silicide phases to be quite low and the phase content of the alloy YR would be expected to be almost identical with the alloy YQ.

The alloy YV is part of the grouping of alloys YQ, YR, and YV. Alloy YV has essentially the same composition as that of YR with the exception that the alloy YV has a higher concentration of aluminum and specifically has 22.5 atomic percent aluminum rather than the 18 atomic percent of aluminum of YR as is evident from comparison of these alloys in Table I. Alloy YV has a sufficiently high level of aluminum that the phases present would be expected, based on prior art considerations, to consist of the ordered hexagonal phase based on $Ti_3Al$ (alpha 2), and a small amount of a tantalum-rich body-centered cubic beta phase with the attendant possible low levels of boride and/or silicide phases.

As is evident from the third group of alloys of Table I, namely alloys YC and YM, the alloy YC has a composition similar to that of alloy YF with the exception that the aluminum is 6% lower, and there is present in the alloy YC, 3 atomic percent of gallium and 3 atomic percent of tin. Accordingly, the alloy YC has the composition Ti-12 At % Al-3 At % Ga-3 At % Sn-6 At % Cb-2 At % Ta-0.8 At % Si. In effect, the gallium and tin substituents take the place of an equal amount of aluminum. Based on prior art considerations, the phase content would be expected to consist of aluminum, gallium, and tin-rich hexagonal close-packed alpha phase in which there are precipitates of an ordered phase based on $Ti_3Al$ (alpha 2) and a small amount of columbium and tantalum-rich body-centered cubic beta phase. The alloy YM copies the composition of alloy YC precisely with the exception that 1.5 atomic percent hafnium and 0.06 atomic percent boron are added to the alloy YC in place of an equal amount of titanium.

The next group of alloys in Table I are the alloys YI and YN. Alloy YI has a composition closely similar to that of alloy YC with the exception that the tantalum concentration is lower by about 1.5% and there is present in the YI composition half atomic percent additives of vanadium, molybdenum, and tungsten. The alloy YN has a composition corresponding to that of alloy YI with the exception that alloy YN also contains 1.5 atomic percent of hafnium and 0.06 atomic percent of boron. Based on prior art considerations the phases of alloy YI would be expected to consist of aluminum, gallium, and tin-rich hexagonal close packed alpha phase in which there are precipitates of an ordered phase based on $Ti_3Al$ (alpha 2) and a small amount of a columbium, tantalum, vanadium, molybdenum, tungsten-rich body-centered cubic beta phase.

The foregoing comments regarding the nature of the alloys of Table I and the form of these alloys based on prior art considerations deals with the alloys as prepared by conventional processing.

However, the alloys of the present invention were prepared by arc melting in a copper crucible and by melt spinning the metal from the crucible. The melt spun ribbon was compacted by hot isostatic pressing (HIPping) at 840° C. followed by extrusion at 840° C. with an extrusion ratio of 8 to 1. The extruded alloys were given a heat treatment consisting of a solution treatment above the beta transus followed by aging below the beta transus. The beta solution was carried out at 1200° C. for two hours for all alloys except YQ and YR which were given a solution treatment at 1150° C. The aging for all alloys was at 900° C. for 24 hours plus an additional 750° C. aging for 24 hours, except for YV whose aging times were 8 hours.

Selected alloys were also evaluated by press forging of conventionally solidified buttons. The press forgings were conducted at 900° C. Heat treatments also consisted of beta solution treatments and aging below the beta transus.

What I have found is that boron additions on the order of 0.06 atomic percent modify the structure of titanium alloys to yield much shorter alpha plates. This effect of reducing the size of the alpha plates is most pronounced in rapidly solidified alloys although it occurs also in conventionally solidified alloys. Boron containing alloys produced at more conventional solidification rates additionally contain a coarse phase which is observed to be aligned along the direction of thermo mechanical processing and which I have determined is probably a boride. The evidence which I developed for the conclusion drawn that the addition of relatively low concentration of boron results in modification of the structure of the titanium alloys is contained in photomicrographs which accompany this application and form FIGS. 5, 6 and 7 hereof. Each of these figures has three parts identified as A, B, and C. FIG. 5 contains photomicrographs of the rapidly solidified, consolidated, and heat treated alloys YF, YK, and YL. FIG. 6 contains photomicrographs of the rapidly solidified, consolidated, and heat treated alloys YQ, YR, and YV. FIG. 7 contains photomicrographs of conventionally processed alloys YQ, YR and YV.

Turning now to the photomicrographs of FIG. 5, the figure illustrates the micrographs of the heat-treated extrusions of rapidly solidified alloys YF, YK, and YL as set out in Table I. The base alloy YF has a transformed beta microstructure where alpha plates (the white etching phase), between about 50 and 100 microns (μm) long are oriented in three directions within the beta grains from which they grew. The microstructures of alloys YK and YL differ strikingly from the structure of alloy YF. The alpha plates of the micrographs of alloys YK and YL are much shorter in length, about 20 microns long, but are about the same thickness as those of YF. The alpha plates of the micrographs of alloys YK and YF appear to be oriented in the three directions with respect to their parent beta grains but the plates are so short that a basketweave pattern does not appear.

FIG. 6 illustrates the heat treated extrusions of rapidly solidified alloys YQ, YR, and YV as the composition of these alloys is set forth in Table I. The base alloy YQ has a transformed beta microstructure where alpha plates between about 40 and 80 microns (μm) long are oriented in three directions within the beta grains from which they grew. Prior beta grains are defined by grain boundary alpha. The alpha plates of alloy YQ are much finer than those of alloy plate YF, but are of about the same length. The difference in fineness and length of the alpha plates of alloy YQ versus those of YF may reflect the difference between the effect of tantalum and that of columbium on the form of the alpha plates which are formed. The alpha plates of alloy YQ in the three orientations intersect one another in a basketweave pattern. The microstructure of the boron-containing alloys, YR and YV, differ strikingly from the microstructure of alloy YQ as is evident from FIG. 6. The alpha plates of alloy YR are much shorter in length, but are of about the same thickness as those of alloy YQ. The alpha plates of the YQ microstructure appear to be oriented in the three directions with respect to their parent beta grain but the plates of the microstructure are so short that a basketweave pattern does not appear. The alpha plates of the microstructure of alloy YV are much shorter and somewhat thicker than those of base alloy YQ. The length of the alpha plates in YR and YV is less than about 20 microns.

Turning now to FIG. 7, there is illustrated micrographs of the heat treated forgings of conventionally solidified alloys YQ, YR, and YV, compositions of which are listed in Table I. From the micrograph of the base alloy YQ, it is evident that the alloy has a transformed beta microstructure very similar to the rapidly solidified one where alpha plates are oriented in three directions within the beta grains from which they grew. Prior beta grains are outlined in the micrograph by grain boundary alpha. It is also evident from the micrographs that the heat treated structure of the press forgings of the boron-containing alloys YR and YV are not as different from the micrograph of the base alloy YQ as they are for the rapidly solidified case. Thus, the alpha plates evident in the micrograph of alloy YR are shorter in length but are about the same thickness as those of the micrograph of alloy YQ. From the micrograph, it is also evident that the plates are arranged in colonies of parallel plates rather than in a basketweave pattern and there are stringers of an additional phase oriented along the forging direction. From my study of these alloys, I deem it likely that the additional phase is a boride. The structure evident from the micrographs of the conventionally solidified alloy YV is more similar to that of the base alloy YQ in that grain boundary alpha is present and the alpha plates within a grain are much less refined than in the case of the rapidly solidified alloys.

In summary, from a review and study of the micrographs of these alloys, it is evident that boron additions of the order of 0.06 atomic percent modify the structure of titanium alloys to yield much shorter alpha plates after a beta solution and as a heat treatment. The effect is more pronounced in rapidly solidified alloys. Boron-containing alloys produced at more conventional rates also contain a coarse phase which is deemed to probably be a boride aligned along the direction of thermo-mechanical processing.

I have found that the average alpha phase plate structure observed in the final microstructure of the alloy is relatively small and that its small size is important to the desirable properties displayed by these alloys. In particular, I have found that when the alpha phase plate structure is less than about 50 microns, the alloy has desirable ductility at room temperature as well as good high temperature properties.

The mechanical properties of the alloys, the compositions of which are set forth in Table I, were tested. The rapidly solidified and consolidated alloys were evaluated in tensile tests at room temperature and at elevated temperatures. The results of the testing which was done are listed in Table II, immediately below.

TABLE II

Tensile Behavior of Rapidly Solidified Alloys

| Alloy | Temp. | Y.S. | U.T.S. | % El. max load | % El. failure | % R.A. |
|---|---|---|---|---|---|---|
| YF (5 Cb) | RT | 130.2 | 130.2 | 0.1 | 0.1 | 0.0 |
| YF | RT | 116.0 | 116.0 | 0.0 | 0.0 | 1.0 |
| YF | 750° C. | 56.1 | 65.9 | 2.2 | 3.6 | 4.5 |
| YF | 900° C. | 27.8 | 32.4 | 1.4 | 6.0 | 6.1 |
| YK (5 Cb-.06 B) | RT | 138.8 | 143.6 | 0.5 | 0.5 | 4.9 |
| YK | 650° C. | 69.7 | 83.2 | 5.7 | 10.0 | 14.3 |
| YK | 750° C. | 52.3 | 60.4 | 2.6 | 5.6 | 4.4 |
| YK | 900° C. | 21.8 | 30.5 | 1.6 | 7.9 | 9.4 |
| YL (5 Cb-1.5 Hf-.06 B) | RT | 124.3 | 132.6 | 0.5 | 0.8 | 1.3 |
| YL | 650° C. | 70.0 | 87.7 | 6.7 | 12.8 | 17.6 |
| YL | 750° C. | 55.7 | 66.0 | 2.8 | 7.3 | 9.7 |
| YL | 900° C. | 27.6 | 31.1 | 1.3 | 6.4 | 7.4 |
| YQ (5 Ta) | RT | 139.0 | 139.0 | 0.0 | 0.0 | 1.5 |
| YQ | 650° C. | 101.8 | 117.1 | 1.8 | 2.5 | 4.9 |
| YQ | 750° C. | 77.8 | 88.6 | 1.5 | 2.5 | 4.9 |
| YQ | 900° C. | 30.1 | 33.8 | 1.0 | 11.5 | 11.5 |
| YQ | 1000° C. | 12.6 | 16.0 | 1.2 | 16.4 | 14.9 |
| YQ | 1100° C. | 1.9 | 2.4 | 1.0 | 80.4 | 93.8 |
| YR (5 Ta-1.5 Hf-.06 B) | RT | 161.8 | 174.2 | 1.3 | 1.3 | 3.2 |
| YR | 650° C. | 102.2 | 119.8 | 4.5 | 5.8 | 10.6 |
| YR | 750° C. | 68.4 | 77.9 | 2.1 | 6.9 | 10.4 |
| YR | 900° C. | 25.7 | 26.8 | 0.8 | 42.5 | 54.8 |
| YR | 1100° C. | 1.8 | 2.0 | 2.8 | 26.3 | 13.2 |
| YV (22.5 Al-5 Ta-) | RT | 115.67 | 140.6 | 3.5 | 3.5 | 2.0 |
| YV (1.5 Hf-.06 B) | 650° C. | 65.7 | 97.7 | 22.0 | 23.6 | 20.4 |
| YV | 750° C. | 53.1 | 63.2 | 9.1 | 19.0 | 21.6 |
| YV | 900° C. | 37.1 | 41.5 | 1.8 | 18.0 | 19.1 |
| YV | 1000° C. | 12.8 | 14.1 | 1.2 | 132.6 | 81.1 |
| YV | 1100° C. | 3.3 | 3.7 | 1.9 | 110.9 | 95.1 |
| YC (3 Ga-3 Sn-6 Cb-2 Ta) | RT | 105.8 | 105.8 | 0.0 | 0.0 | 0.0 |
| YC | 750° C. | 46.4 | 56.1 | 1.6 | 8.6 | 11.7 |
| YM (3362-.06 B) | RT | 122.1 | 142.9 | 1.4 | 1.4 | 4.2 |
| YM | 750° C. | 42.6 | 48.5 | 2.2 | 14.5 | 19.0 |
| YM | 900° C. | 14.9 | 22.4 | 2.1 | 30.3 | 44.4 |
| YI (3 Ga-3 Sn-3 Cb-.5 Ta) | RT | 125.8 | 125.8 | 0.0 | 0.0 | 2.0 |
| YI (.5 V-.5 Mo-.5 W) | RT | 116.6 | 116.6 | 0.0 | 0.0 | 0.0 |
| YI | 750° C. | 48.9 | 56.7 | 1.7 | 4.5 | 7.4 |
| YN (3 Ga-3 Sn-3 Cb-.5 Ta) | RT | 134.8 | 146.7 | 0.6 | 0.6 | 2.3 |
| YN (.5 V-.5 Mo-.5 W-.06 B) | 650° C. | 68.0 | 83.1 | 3.7 | 10.6 | 12.1 |
| YN | 750° C. | 37.0 | 48.2 | 2.4 | 14.5 | 14.6 |
| YN | 900° C. | 16.8 | 20.9 | 1.4 | 24.8 | 41.6 |

From the results presented in Table II, it is evident that for all of the variety of alloys prepared, boron had an unexpectedly beneficial effect on low temperature strength and ductility.

Considering now the first group of alloys as listed in Table I, and specifically alloys YF, YK, and YL, it is evident from Table II that alloy YF has only 0.1% tensile elongation and has a 130 ksi ultimate tensile strength at room temperature. The poor room temperature ductility of alloy YF renders it essentially useless for structural applications. In contrast to this very low tensile elongation, the alloy YK which contained the boron has a 0.5% elongation, or 5× greater elongation, than alloy YF. Also alloy YK has an ultimate tensile strength of 143 ksi or about 10% higher than the ultimate tensile strength of the YF alloy which contained no boron. The alloy YL which contained both hafnium and boron had a 0.8% elongation and had an ultimate tensile strength of 132 ksi at room temperature. Here again, there is a striking and unexpected improvement in the physical properties of the alloy containing hafnium and boron additives.

Figure 2:
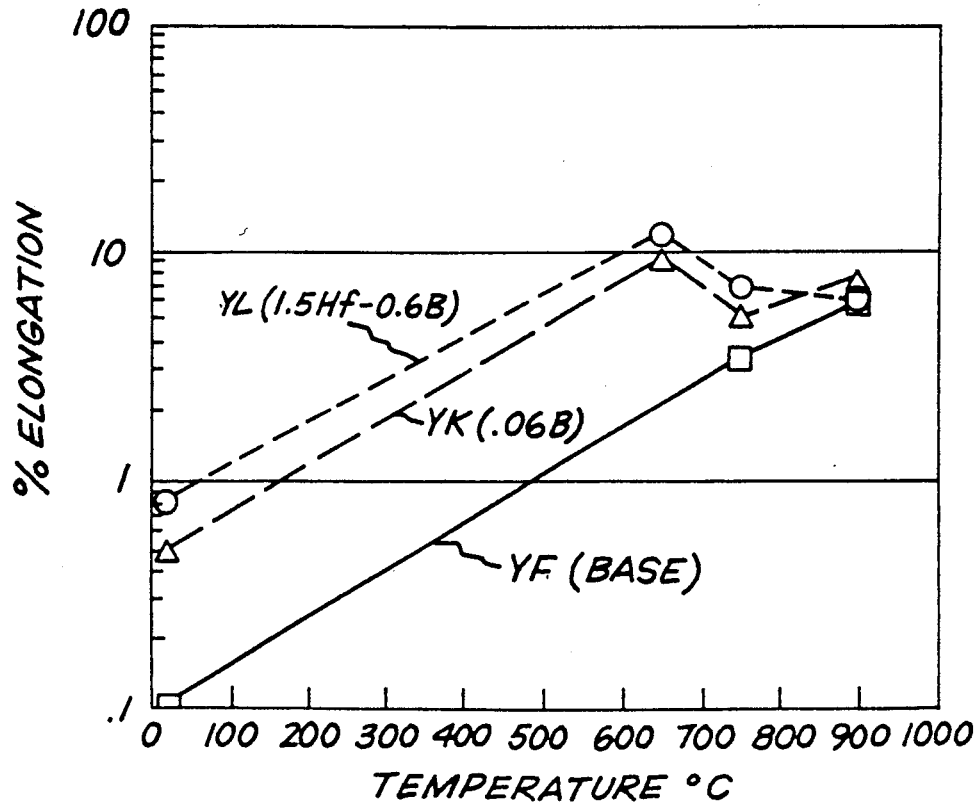
FIG. 2 is a graph in which elongation percent is plotted against temperature in degrees centigrade for the same alloy group as that plotted in FIG. 1.

Higher temperature testing was also done on these alloys. At 750° C. the ultimate tensile strength for alloy YF is 65.9 ksi and this is reduced to 60.4 ksi for alloy YK. For alloy YL containing both boron and hafnium, the 750° strength measurement revealed that there is essentially no change in strength for the YL alloy as compared to YF. These results are graphically displayed in FIGS. 1 and 2 which plot the yield strength and elongation as a function of temperature for alloys YF, YK, and YL.

Figure 3:
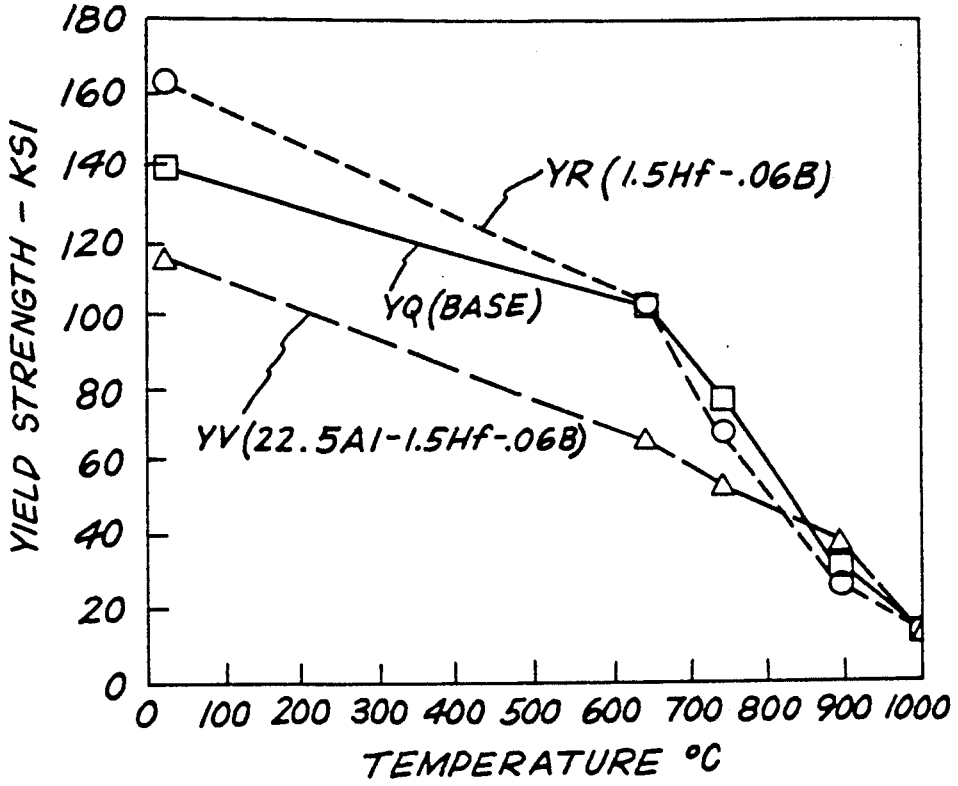
FIG. 3 is a graph similar to FIG. 1 but for a different alloy base composition group.
Figure 4:
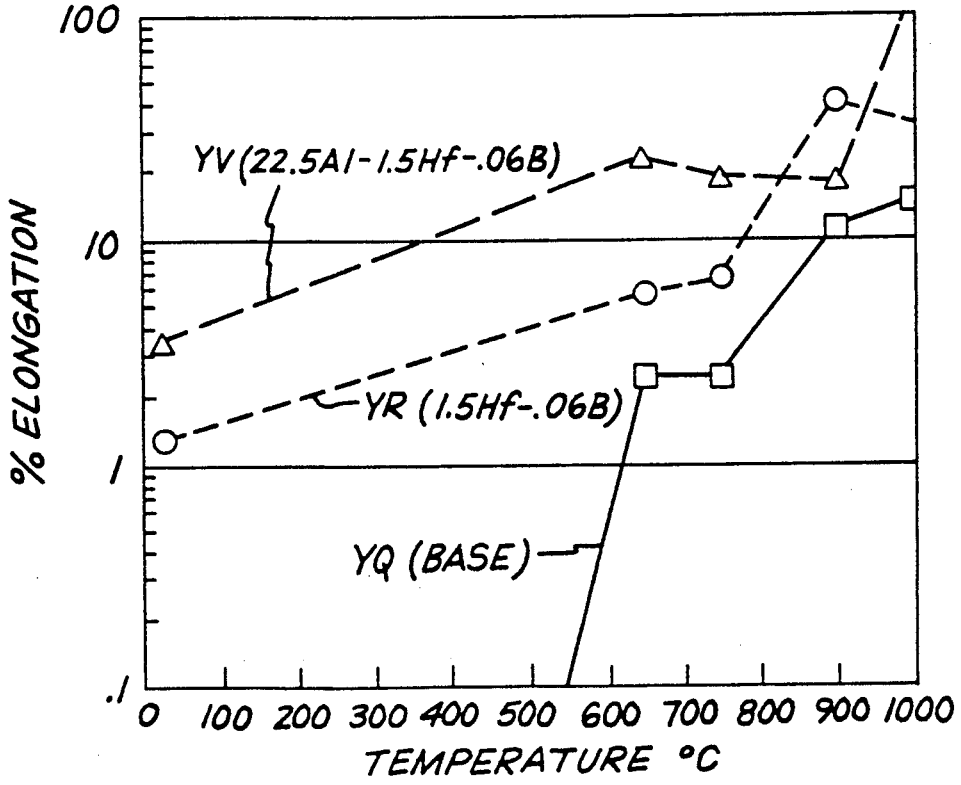
FIG. 4 is a graph similar to that of FIG. 2 and displaying the elongation relative to temperature for the same alloy group as is plotted with respect to FIG. 3.

Turning now to the next series of three alloys, as listed in Table I and specifically alloys YQ, YR, and YV, testing at room temperature revealed that alloy YQ has essentially zero tensile elongation at room temperature and an ultimate tensile strength at room temperature of 139 ksi. Here again, the poor room temperature ductility of alloy YQ renders it essentially useless for structural applications. In contrast to the physical properties of the alloy YQ, the alloy YR which contains the boron and hafnium additives has a 1.3% elongation and 174 ksi ultimate tensile strength At the higher temperatures, the testing revealed that the alloy YR containing hafnium and boron had an ultimate tensile strength at 750° C. of 77.9 ksi whereas the tensile strength of the alloy free of hafnium and boron was 88.6 ksi at 750° C. for alloy YQ. Accordingly, there was a relative loss of tensile strength at the elevated temperature for the alloy containing the boron and hafnium as compared to the alloy free of the boron and hafnium. For the alloy YV which contained the hafnium and boron plus a higher percentage of aluminum as set forth in Table I, the elongation measured was 3.5% and the ultimate tensile strength was 140.6 ksi. The strength at elevated temperature for alloy YV is slightly lower than that for alloy YQ at 650° C. and 750° C. but the strength is greater at 900° C. than for the base alloy YQ. These results are graphically displayed in FIGS. 3 and 4 which plot the yield strength and elongation as a function of temperature for the alloys YQ, YR, and YV.

Turning now to the last two groups of alloys, compositions of which are included in Table I, tests were made on the alloys YC and YM. Alloy YC was found to have essentially zero tensile elongation and an ultimate tensile strength of about 105.8 ksi at room temperature. The poor room temperature ductility of alloy YC renders it useless entirely for structural applications. By contrast, alloy YM was found to have an elongation of 1.4% and an ultimate tensile strength of about 142.9 ksi. At 750° C., the ultimate strength for alloy YM was 48.4 ksi and that for alloy YC was 56.1 ksi. The addition of the boron additive to alloy YC is thus seen to be very effective in providing a very substantial increase in ultimate tensile strength over that found for alloy YC and, in addition, a truly remarkable increase in room temperature ductility of the boron containing YM alloy as compared to the boron YC alloy.

Considering next the last group of alloys listed in Table I and specifically alloys YI and YN, the alloy YI was tested and found to have a zero tensile elongation at room temperature together with an ultimate tensile strength of about 125.8 ksi. The zero tensile strength renders this alloy essentially useless for structural applications. Alloy YN which has the same composition as that of alloy YI, the exception of the addition of 1.5% hafnium and 0.06% boron was also tested. Test results show very substantial improvement in properties for the alloy containing the hafnium and boron additives over the alloy YI from which they were absent. Alloy YN was found to have an elongation of 0.6% and an ultimate tensile strength of 146.7 ksi. The strength at elevated temperatures for the YN alloy was 48.2 ksi and that for the YI alloy was 56.7 ksi. Here again, in this illustration, the effectiveness of the boron additive in improving ductility of the essentially brittle starting alloy YI has been demonstrated.

The entire foregoing discussion concerned the results achieved in the study of alloys which were processed through rapid solidification. A study was made of three alloys, and specifically YQ, YR, and YV, which alloys were prepared by conventional solidification processing followed by pressed forgings. The results of these tests are listed in Table III immediately below.

TABLE III

| Tensile Behavior of Conventionally Cast Forgings | | | | | | |
|---|---|---|---|---|---|---|
| Alloy | Temp. | Y.S. | U.T.S. | % El. max load | % El. failure | % R.A. |
| YQ (5 Ta) | RT | 135.6 | 143.1 | 0.4 | 0.4 | 3.7 |
| YR (5 Ta-1.5 Hf-.06 B) | RT | 151.4 | 165.0 | 0.9 | 0.9 | 2.9 |
| YV (22.5 Al-5 Ta-) (1.5 Hf-.06 B) | RT | 108.5 | 113.1 | 0.3 | 0.3 | 0 |

Alloy YQ which contained no boron or hafnium was found to have a tensile elongation at room temperature of 0.4% and to have an ultimate tensile strength at that temperature of 143.1 ksi. The alloy YR which did contain both hafnium and boron had a significantly higher elongation of 0.9% and substantially higher ultimate tensile strength of 165 ksi at room temperature. However, the YV alloy which had both the increased aluminum content as well as the hafnium and boron additives had a lower elongation of 0.3% at room temperature and a lower ultimate tensile strength of 113.1 ksi.

From these results, it can be concluded that there is only a slight improvement in tensile behavior on boron additions for the conventionally processed alloys on the basis of the comparison results obtained with alloy YQ which had no boron or hafnium and alloy YR which had both hafnium and boron additives present. Further, there is no evident improvement when the aluminum level is raised as is the case when comparison is made between the composition of alloy YK which had lower aluminum and was free from boron and hafnium with the alloy YV which had the higher aluminum content as well as the indicated percentages of boron and hafnium. It appears likely that the absence of the rapid solidification in alloy processing caused more boron to precipitate in the form of blocky borides and with reduced or no modification of the microstructure of the resulting alloy. Certainly, the microstructure was not modified to the same degree as was the case with the rapidly solidified alloys. Moreover, where the boron acted as an embrittling phase, it could have a tendency to start cracks and thus effect the mechanical properties that are determined from the tests.

The optimal level of boron in alloys will be a function of solidification processing technique. From our results, the boron level should be below that which will produce a coarse precipitate phase characterized by borides greater than about 5 μm in length. Accordingly, the level of boron must be below 0.06 atomic percent for conventionally processed alloys and as low as 0.01 to a level just above an impurity level. The boron level can be higher for alloys produced by rapid solidification.

An upper level of boron content can be estimated from the prior art work in which the intent was to produce stable borides Brooks et al. in U.S. Pat. No. 3,199,980 and Evans and Smith in U.S. Pat. No. 3,340,051 suggest a minimum level of about 0.5 weight percent (about 2 atomic percent) for obtaining a precipitated dispersed phase. Since a boride phase is undesirable in this invention, 2 atomic percent can be considered an upper practical maximum.

Further, defining the relationship between boron level and solidification processing is the unique association of a refined microstructure with the improved mechanical properties. The boron content and solidification rate should be such that the refined small alpha plate microstructure as demonstrated in FIGS. 5 and 6 are produced in the final consolidated and heat treated product as discussed above.

From the foregoing, it can be seen that a novel and unique titanium base alloy composition having an alpha or alpha-beta structure can be formed from alloys having the following approximate composition in atomic percent:

| Ingredient | Concentration From About | Concentration To About |
|---|---|---|
| Al | 6 | 30 |
| Sn | 0 | 4 |
| Ga | 0 | 4 |
| Σ Al + Sn + Ga | 6 | 30 |
| Zr | 0 | 6 |
| Hf | 0 | 6 |
| Σ Zr + Hf | 0 | 6 |
| V | 0 | 12 |
| Cb(Nb) | 0 | 12 |
| Ta | 0 | 12 |
| Mo | 0 | 6 |
| W | 0 | 6 |
| Cr | 0 | 6 |
| Ru | 0 | 4 |
| Rh | 0 | 4 |
| Pd | 0 | 4 |
| Pt | 0 | 4 |
| Ir | 0 | 4 |
| Os | 0 | 4 |
| Σ V + Cb + Ta + Cr + Mo + W + Ru + Rh + Pd + Pt + Ir + Os | 0 | 12 |
| Σ C + Y + Rare Earth Metals | 0 | 2 |
| B | 0.01 | 2.0 |
| Ti | balance essentially | |

the final microstructure of said alloy being characterized by an average alpha phase plate length of less than 50 microns.

A finer microstructure is formed with a composition as follows in atomic percent:

| Ingredient | Concentration From About | Concentration To About |
|---|---|---|
| Al | 16 | 20 |
| Sn | 0 | 4 |
| Ga | 0 | 4 |
| Σ Al + Sn + Ga | 16 | 20 |
| Zr | 0 | 2 |
| Hf | 0 | 2 |
| Σ Zr + Hf | 0 | 2 |
| Cb (Nb) | 0 | 5 |
| Ta | 0 | 5 |
| Σ V + Cb + Ta + Mo + W | 4.5 | 5.5 |
| B | 0.01 | 0.4 |
| Ti | balance essentially | |

the final microstructure of said alloy being characterized by an average alpha plate length of less than 30 microns.

What is claimed is:

1. An alpha or alpha-beta titanium base alloy composition, said composition consisting essentially of the following ingredients in the following concentrations in atomic percent:

| Ingredient | Concentration From About | Concentration To About |
|---|---|---|
| Al | 6 | 30 |
| Sn | 0 | 4 |
| Ga | 0 | 4 |
| Σ Al + Sn + Ga | 6 | 30 |
| Zr | 0 | 6 |
| Hf | 0 | 6 |
| Σ Zr + Hf | 0 | 6 |
| V | 0 | 12 |
| Cb(Nb) | 0 | 12 |
| Ta | 0 | 12 |
| Mo | 0 | 6 |
| W | 0 | 6 |
| Cr | 0 | 6 |
| Ru | 0 | 4 |
| Rh | 0 | 4 |
| Pd | 0 | 4 |
| Pt | 0 | 4 |
| Ir | 0 | 4 |
| Os | 0 | 4 |
| Σ V + Cb + Ta + Cr + Mo + W + Ru + Rh + Pd + Pt + Ir + Os | 0 | 12 |
| Σ C + Y + Rare Earth Metals | 0 | 2 |
| B | 0.01 | 2.0 |
| Ti | balance essentially | |

said alloy having been prepared by rapid solidification and HIPing, the final microstructure of said alloy being characterized by an average alpha phase plate length of less than 50 microns.

2. An alpha or alpha-beta titanium base alloy composition, said composition consisting essentially of the following ingredients in the following concentrations in atomic percent:

| Ingredient | Concentration From About | Concentration To About |
|---|---|---|
| Al | 6 | 30 |
| Sn | 0 | 4 |
| Ga | 0 | 4 |
| Σ Al + Sn + Ga | 6 | 30 |
| Zr | 0 | 6 |
| Hf | 0 | 6 |
| Σ Zr + Hf | 0 | 6 |
| V | 0 | 12 |
| Cb (Nb) | 0 | 12 |
| Ta | 0 | 12 |
| Mo | 0 | 6 |
| W | 0 | 6 |
| Cr | 0 | 6 |
| Σ V + Cb + Ta + Cr + Mo + W | 0 | 12 |
| Σ C + Y + Rare Earth Metals | 0 | 2 |
| B | 0.01 | 2.0 |
| Ti | balance essentially | |

said alloy having been prepared by rapid solidification and HIPing, the final microstructure of said alloy being characterized by an average alpha phase plate length of less than 50 microns.

3. An alpha or alpha-beta titanium base alloy composition, said composition consisting essentially of the following ingredients in the following concentrations in atomic percent:

| Ingredient | Concentration From About | Concentration To About |
|---|---|---|
| Al | 6 | 30 |
| Sn | 0 | 4 |
| Ga | 0 | 4 |
| Σ Al + Sn + Ga | 6 | 30 |
| Zr | 0 | 6 |
| Hf | 0 | 6 |
| Σ Zr + Hf | 0 | 6 |
| V | 0 | 12 |
| Cb (Nb) | 0 | 12 |
| Ta | 0 | 12 |
| Mo | 0 | 6 |
| W | 0 | 6 |
| Σ V + Cb + Ta + Cr + Mo + W | 0 | 10 |
| Σ C + Y + Rare Earth Metals | 0 | 2 |
| B | 0.01 | 2.0 |
| Ti | balance essentially | |

said alloy having been prepared by rapid solidification and HIPing, the final microstructure of said alloy being characterized by an average alpha phase plate length of less than 50 microns.

4. An alpha or alpha beta titanium base alloy composition, said composition consisting essentially of the following ingredients in the following concentrations in atomic percent:

| Ingredient | Concentration From About | Concentration To About |
|---|---|---|
| Al | 12 | 25 |
| Sn | 0 | 4 |
| Ga | 0 | 4 |
| Σ Al + Sn + Ga | 12 | 25 |
| Zr | 0 | 6 |
| Hf | 0 | 6 |
| Σ Zr + Hf | 0 | 6 |
| V | 0 | 5 |
| Cb (Nb) | 0 | 7 |
| Ta | 0 | 7 |
| Mo | 0 | 2 |
| W | 0 | 2 |
| Σ V + Cb + Ta + Mo + W | 3 | 10 |
| B | 0.01 | 2.0 |
| Ti | balance essentially | |

said alloy having been prepared by rapid solidification and HIPing, the final microstructure of said alloy being characterized by an average alpha phase plate length of less than 50 microns.

5. An alpha or alpha beta titanium base alloy composition, said composition consisting essentially of the following ingredients in the following concentrations in atomic percent:

| Ingredient | Concentration From About | Concentration To About |
|---|---|---|
| Al | 16 | 25 |
| Sn | 0 | 4 |
| Ga | 0 | 4 |
| Σ Al + Sn + Ga | 16 | 25 |
| Zr | 0 | 6 |
| Hf | 0 | 6 |
| Σ Zr + Hf | 0 | 6 |
| V | 0 | 5 |
| Cb (Nb) | 0 | 7 |
| Ta | 0 | 7 |
| Mo | 0 | 2 |
| W | 0 | 2 |

-continued

| Ingredient | Concentration From About | Concentration To About |
|---|---|---|
| Σ V + Cb + Ta + Mo + W | 3 | 10 |
| B | 0.01 | 2.0 |
| Ti | balance essentially | |

said alloy having been prepared by rapid solidification and HIPing, the final microstructure of said alloy being characterized by an average alpha phase plate length of less than 40 microns.

6. An alpha or alpha beta titanium base alloy composition, said composition consisting essentially of the following ingredients in the following concentrations in atomic percent:

| Ingredient | Concentration From About | Concentration To About |
|---|---|---|
| Al | 16 | 25 |
| Sn | 0 | 4 |
| Ga | 0 | 4 |
| Σ Al + Sn + Ga | 16 | 25 |
| Zr | 0 | 4 |
| Hf | 0 | 4 |
| Σ Zr + Hf | 0 | 4 |
| V | 0 | 5 |
| Cb (Nb) | 0 | 5 |
| Ta | 0 | 5 |
| Mo | 0 | 2 |
| W | 0 | 2 |
| Σ V + Cb + Ta + Mo + W | 4 | 6 |
| B | 0.01 | 1.0 |
| Ti | balance essentially | |

said alloy having been prepared by rapid solidification and HIPing, the final microstructure of said alloy being characterized by an average alpha phase plate length of less than 40 microns.

7. An alpha or alpha beta titanium base alloy composition, said composition consisting essentially of the following ingredients in the following concentrations in atomic percent:

| Ingredient | Concentration From About | Concentration To About |
|---|---|---|
| Al | 16 | 20 |
| Sn | 0 | 4 |
| Ga | 0 | 4 |
| Σ Al + Sn + Ga | 16 | 20 |
| Zr | 0 | 2 |
| Hf | 0 | 2 |
| Σ Zr + Hf | 0 | 2 |
| V | 0 | 5 |
| Cb (Nb) | 0 | 5 |
| Ta | 0 | 5 |
| Mo | 0 | 2 |
| W | 0 | 2 |
| Σ V + Cb + Ta + Mo + W | 4 | 6 |
| B | 0.01 | 1.0 |
| Ti | balance essentially | |

said alloy having been prepared by rapid solidification and HIPing, the final microstructure of said alloy being characterized by an average alpha phase plate length of less than 40 microns.

8. An alpha or alpha beta titanium base alloy composition, said composition consisting essentially of the following ingredients in the following concentrations in atomic percent:

| Ingredient | Concentration From About | Concentration To About |
|---|---|---|
| Al | 16 | 20 |
| Sn | 0 | 4 |
| Ga | 0 | 4 |
| Σ Al + Sn + Ga | 16 | 20 |
| Zr | 0 | 2 |
| Hf | 0 | 2 |
| Σ Zr + Hf | 0 | 2 |
| Cb (Nb) | 0 | 5 |
| Ta | 0 | 5 |
| Σ V + Cb + Ta + Mo + W | 4 | 6 |
| B | 0.01 | 1.0 |
| Ti | balance essentially | |

said alloy having been prepared by rapid solidification and HIPing, the final microstructure of said alloy being characterized by an average alpha phase plate length of less than 40 microns.

9. An alpha or alpha beta titanium base alloy composition, said composition consisting essentially of the following ingredients in the following concentrations in atomic percent:

| Ingredient | Concentration From About | Concentration To About |
|---|---|---|
| Al | 16 | 20 |
| Sn | 0 | 4 |
| Ga | 0 | 4 |
| Σ Al + Sn + Ga | 16 | 20 |
| Zr | 0 | 2 |
| Hf | 0 | 2 |
| Σ Zr + Hf | 0 | 2 |
| Cb (Nb) | 0 | 5 |
| Ta | 0 | 5 |
| Σ V + Cb + Ta + Mo + W | 4.5 | 5.5 |
| B | 0.01 | 1.0 |
| Ti | balance essentially | |

said alloy having been prepared by rapid solidification and HIPing, the final microstructure of said alloy being characterized by an average alpha phase plate length of less than 30 microns.

10. An alpha or alpha-beta titanium base alloy consisting essentially of 6 to 30 atomic percent of aluminum, up to 4 atomic percent of tin or gallium or a combination thereof, 0.01 to 2.0 atomic percent of boron and the balance essentially titanium, said alloy having been prepared by rapid solidification and HIPing, said alloy having a final microstructure characterized by an average alpha phase length of less than 50 microns.

* * * * *